US011583718B2

(12) United States Patent
Burkhardt

(10) Patent No.: US 11,583,718 B2
(45) Date of Patent: Feb. 21, 2023

(54) HYDRAULIC RESISTANCE EXERCISE APPARATUS

(71) Applicant: Matthew Boyd Burkhardt, East Norwich, NY (US)

(72) Inventor: Matthew Boyd Burkhardt, East Norwich, NY (US)

( * ) Notice: Subject to any disclaimer, the term of this patent is extended or adjusted under 35 U.S.C. 154(b) by 126 days.

(21) Appl. No.: 16/947,193

(22) Filed: Jul. 22, 2020

(65) Prior Publication Data

US 2022/0023694 A1 Jan. 27, 2022

(51) Int. Cl.

*A63B 21/008* (2006.01)
*A63B 21/00* (2006.01)
*A63B 23/035* (2006.01)

(52) U.S. Cl.

CPC ..... *A63B 21/008* (2013.01); *A63B 21/00069* (2013.01); *A63B 21/157* (2013.01); *A63B 21/4034* (2015.10); *A63B 21/4035* (2015.10); *A63B 21/4047* (2015.10); *A63B 23/03541* (2013.01); *A63B 2208/0233* (2013.01); *A63B 2225/09* (2013.01)

(58) Field of Classification Search

CPC ..... A63B 21/4043; A63B 21/4035; A63B 21/4047; A63B 21/00069; A63B 21/157; A63B 23/03541; A63B 2208/0233; A63B 2225/09; A63B 21/0083; A63B 21/00058; A63B 21/008–0088; A63B 23/03558; A63B 23/03575; A63B 21/4034

See application file for complete search history.

(56) References Cited

U.S. PATENT DOCUMENTS

| | | | | |
|---|---|---|---|---|
| 3,495,824 A | | 2/1970 | Cuinier | |
| 3,758,112 A | | 9/1973 | Crum et al. | |
| 4,249,725 A | | 2/1981 | Mattox | |
| 4,688,791 A | * | 8/1987 | Long | A63B 22/001 482/112 |
| 4,723,774 A | * | 2/1988 | Monforte | A63B 21/008 482/112 |
| 4,784,385 A | | 11/1988 | DAngelo | |
| 5,336,147 A | * | 8/1994 | Sweeney, III | A63B 22/0012 74/594.1 |
| 5,338,272 A | * | 8/1994 | Sweeney, III | A63B 22/0005 74/594.1 |

(Continued)

FOREIGN PATENT DOCUMENTS

| | | | | |
|---|---|---|---|---|
| GB | 2510136 A | * | 7/2014 | A63B 21/4035 |
| WO | WO-8806425 A1 | * | 9/1988 | A21B 5/02 |

(Continued)

*Primary Examiner* — Andrew S Lo
(74) *Attorney, Agent, or Firm* — Dunlap Bennett & Ludwig, PLLC

(57) ABSTRACT

A hydraulic resistance exercise apparatus is disclosed. The apparatus has a frame adjustably supporting at least one drum body. One of an arm bar and a leg bar pivotally attached to the at least one drum body. A hydraulic vane cylinder is carried in each the at least one drum body. The hydraulic vane cylinder has one or more hydraulic channels and at least one vane coupled to one of the arm bar and the leg bar, such that operation of one of the arm bar and the leg bar urges a hydraulic fluid contained within the hydraulic vane cylinder under a resistance by passage of the hydraulic fluid through the one or more hydraulic channels.

6 Claims, 6 Drawing Sheets

(56) References Cited

U.S. PATENT DOCUMENTS

| | | | | |
|---|---|---|---|---|
| 5,354,251 | A | 10/1994 | Sleamaker | |
| 5,527,251 | A | 6/1996 | Davis | |
| 5,665,039 | A | 9/1997 | Wasserman et al. | |
| 5,944,637 | A | 8/1999 | Stickler et al. | |
| 6,030,323 | A | 2/2000 | Fontenot et al. | |
| 7,223,219 | B2 | 5/2007 | Liester | |
| 7,282,014 | B2 | 10/2007 | Krietzman | |
| 7,628,739 | B2 | 12/2009 | Gearon | |
| 7,727,125 | B2 | 6/2010 | Day | |
| 9,017,233 | B2 | 4/2015 | Tai et al. | |
| 10,441,834 | B2 | 10/2019 | Liu et al. | |
| 2010/0035737 | A1* | 2/2010 | Kwon | A63B 21/0056 482/111 |
| 2011/0163577 | A1* | 7/2011 | Anastasov | A61B 90/60 297/183.1 |
| 2017/0209729 | A1 | 7/2017 | King | |
| 2018/0036586 | A1* | 2/2018 | Cristofori | A63B 22/0605 |
| 2018/0214730 | A1 | 8/2018 | Larose et al. | |

FOREIGN PATENT DOCUMENTS

| | | | | |
|---|---|---|---|---|
| WO | WO-03013661 | A1 * | 2/2003 | A63B 22/0007 |
| WO | WO-2004085004 | A1 * | 10/2004 | A63B 21/00076 |

* cited by examiner

HYDRAULIC RESISTANCE EXERCISE APPARATUS

BACKGROUND OF THE INVENTION

The present invention relates to exercise apparatus, and more particularly to variable resistance exercise apparatus.

While many exercise apparatus provide variable resistance for the user during an exercise session, there still remains a problem of exercising arms and legs with resistance in all phases, throughout a range of motion, with little resistance lag during transitions between phases.

Some apparatus use solid weights for resistance. However, these apparatus tend to be bulkier due to the size of the weight stacks employed. Likewise these apparatus have substantially more mechanical parts, which require regular maintenance and are prone to breakage.

As can be seen, there is a need for an improved hydraulic resistance exercise apparatus that provides a greater range of motion (though resistance may not be perfectly regular), with almost no interruption of loading when switching from one movement, or range of movement to the other.

SUMMARY OF THE INVENTION

In one aspect of the present invention, a hydraulic resistance exercise apparatus is disclosed. The hydraulic resistance exercise apparatus includes a frame adjustably supporting an upper drum body and a lower drum body. An arm bar is pivotally attached to the upper drum body and a leg bar is pivotally to the lower drum body. A seat is adjustably attached to the frame. A hydraulic vane cylinder is disposed in each of the upper drum body and the lower drum body. The hydraulic vane cylinder has at least one vane coupled to one of the arm bar and the leg bar, and one or more hydraulic channels. Operation of one of the arm bar and the leg bar urges a hydraulic fluid contained within the hydraulic vane cylinder under a resistance by passage of the hydraulic fluid through the one or more hydraulic channels.

In some embodiments, a seatback adjustably carried by the frame. A handle may be disposed at a distal end of the arm bar. An adjustable footrest disposed at a distal end of the leg bar.

In some embodiments, a gearbox assembly is coupled to the upper drum body and the lower drum body. The gearbox assembly is configured to provide a user selectable resistance to movement of one or more of the arm bar and the leg bar. The gearbox assembly may include one or more planetary gear assemblies having a plurality of planetary gears and a sun gear. A clutch selectively engages the one or more planetary gear assemblies.

In some embodiments, the vane cylinder comprises a plurality of in-line hydraulic vane cylinders. Each of the plurality of in-line hydraulic vane cylinders are selectively engageable to adjust the resistance of the hydraulic resistance exercise apparatus.

In other aspects of the invention, a hydraulic resistance exercise apparatus, is disclosed having a frame adjustably supporting at least one drum body. One of an arm bar and a leg bar are pivotally attached to the at least one drum body. A hydraulic vane cylinder is disposed in each the at least one drum body. The hydraulic vane cylinder has one or more hydraulic channels and at least one vane coupled to one of the arm bar and the leg bar, such that operation of one of the arm bar and the leg bar urges a hydraulic fluid contained within the hydraulic vane cylinder under a resistance by passage of the hydraulic fluid through the one or more hydraulic channels.

In some embodiments, a seat is adjustably supported by the frame. A seatback may also be adjustably supported by the frame.

In other embodiments, the hydraulic vane cylinder comprises a plurality of in-line hydraulic vane cylinders. Each of the plurality of in-line hydraulic vane cylinders are selectively engageable to adjust the resistance of the hydraulic resistance exercise apparatus.

In other embodiments, a gearbox assembly is coupled to the at least one drum body. The gearbox assembly is configured to provide a user selectable resistance to movement of one or more of the arm bar and the leg bar. The gearbox assembly may include one or more planetary gear assemblies having a plurality of planetary gears and a sun gear. The gearbox assembly may also include a clutch to selectively engage the one or more planetary gear assemblies.

These and other features, aspects and advantages of the present invention will become better understood with reference to the following drawings, description and claims.

DETAILED DESCRIPTION

Figure 1:
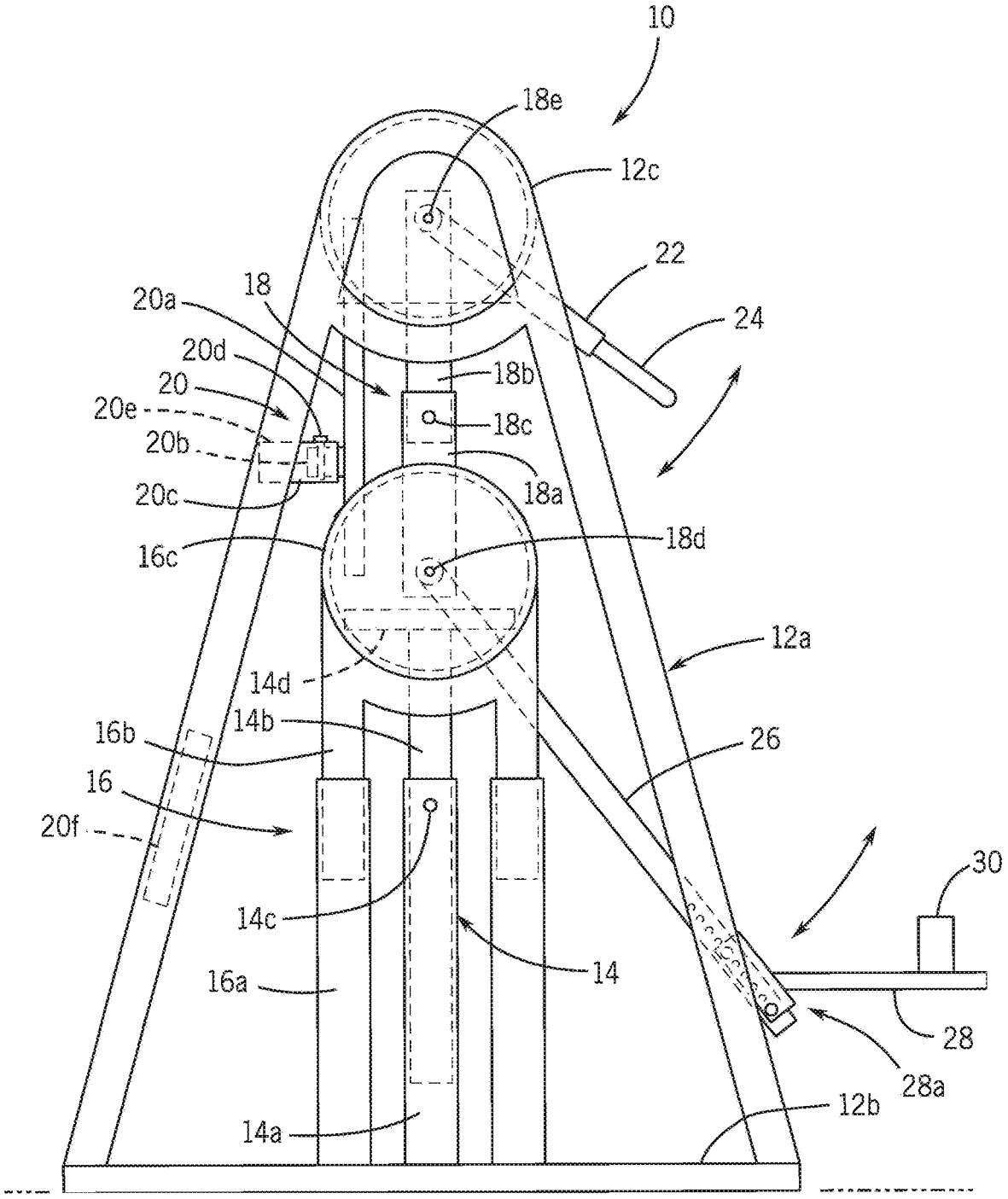
FIG. 1 is a side elevation view of a hydraulic exercise apparatus.
Figure 2:
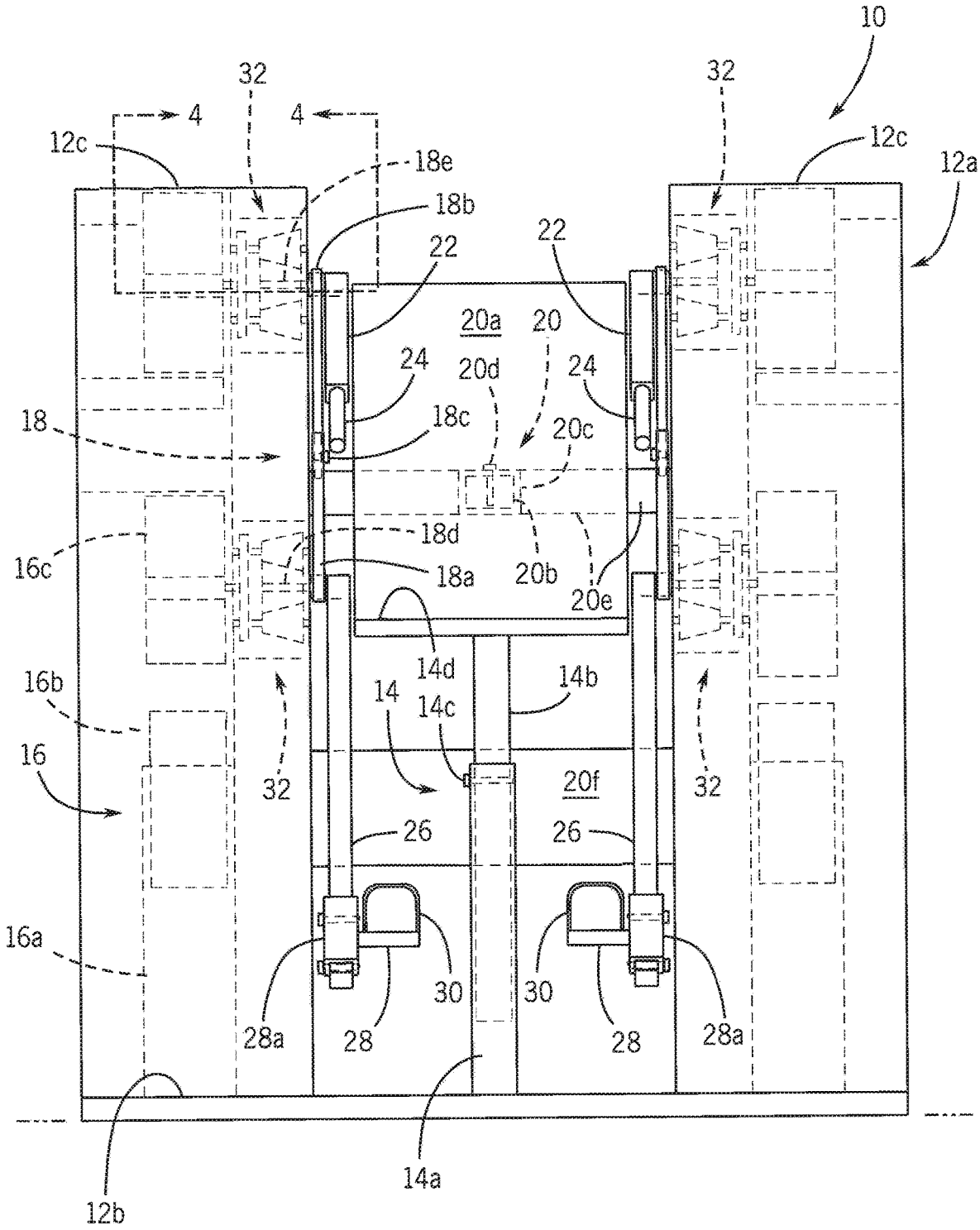
FIG. 2 is a front elevation view of the hydraulic exercise apparatus.
Figure 3A:
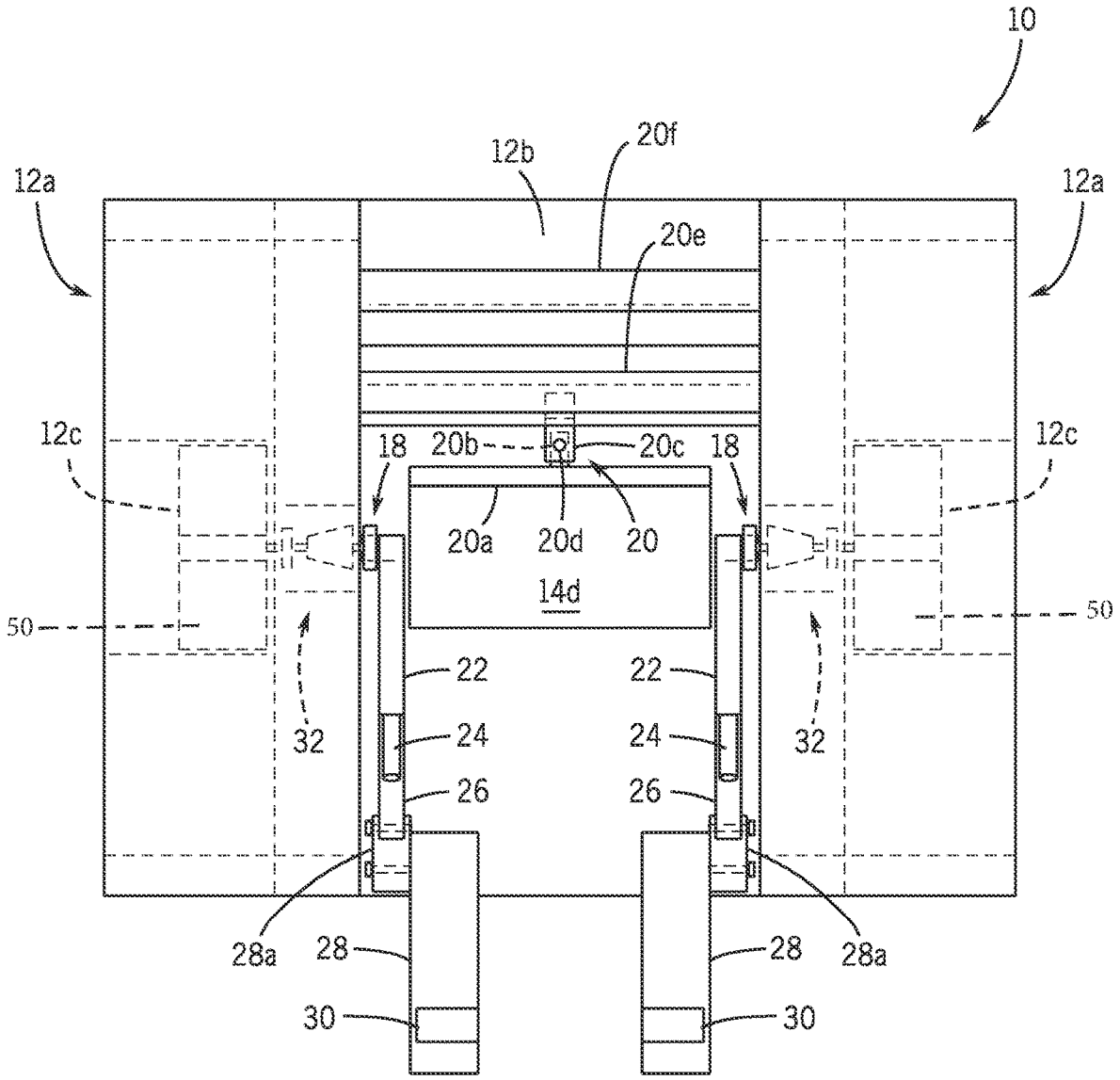
FIG. 3A is a top elevation view of the hydraulic exercise apparatus, indicating in-line in-line hydraulic vane cylinders.
Figure 4:
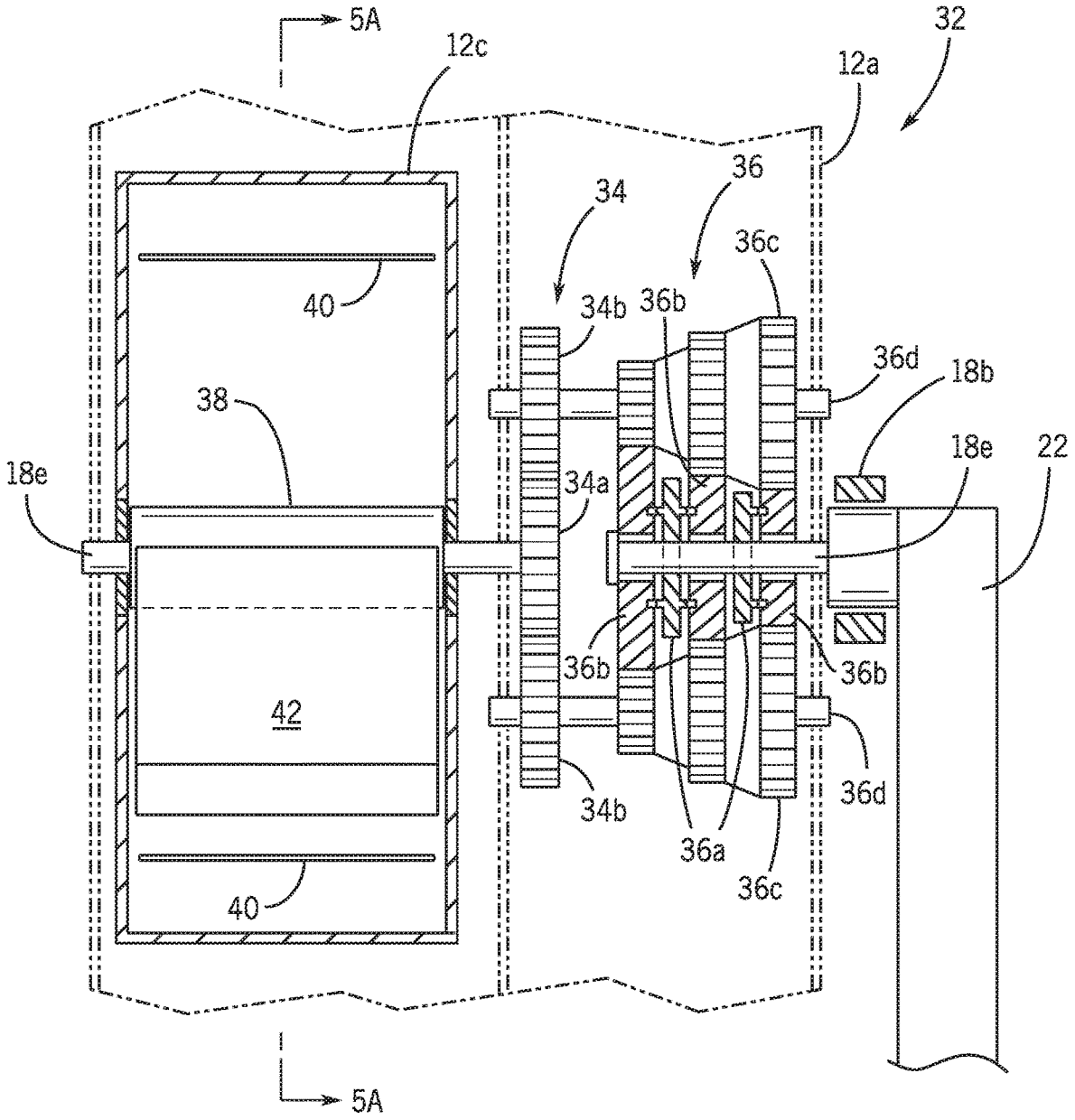
FIG. 4 is an enlarged detail cross-sectional view of the hydraulic exercise apparatus taken on line 4-4 of FIG. 2.

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an apparatus and method for exercise that utilizes a variable hydraulic resistance mechanism that maintains muscle loading throughout a range of motion while utilizing the variable hydraulic resistance apparatus. By using a hydraulic liquid, such as water, to impart frictional resistance, the user will feel a load almost immediately after changing motion direction or selecting a desired range of motion.

As shown in reference to the drawings of FIGS. 1-5, a hydraulic resistance apparatus 10 is shown. The hydraulic resistance apparatus 10 includes a frame 12*a* that is carried on a base 12*b*. In the non-limiting embodiment shown in the drawings, the frame 12*a* may be arrange in an A shape, to support at least one drum body 12*c* at a top end of the frame 12*a*. The upper drum body 12*c* has a pivot shaft 18*e* about which the hydraulic resistance vane drum of the upper drum body 12*c* pivots.

A seat assembly 14 includes a vertically adjustable seat 14*d* that is supported in an interior space within the surrounding frame 12*a*. The seat 14*d* is carried on an adjustment rod 14*b* that is telescopically adjustable relative to a seat adjustment outer cylinder 14*a*. A seat adjustment pin 14*c* may be removed to adjust a vertical position of the seat 14*d*. When a desired seat elevation is achieved, an adjustment pin 14*c* may be inserted through the outer cylinder 14*a*.

The hydraulic resistance apparatus 10 may also include a lower drum stabilizer assembly 16. The lower drum stabilizer assembly is configured to adjustably mount a lower drum body 16*c* within the frame 12*a*. A lower drum stabilizer tube 16*a*, extending from the base 12*b*, adjustably couples to a drum stabilizer rod 16*b*. The lower drum stabilizer assembly 16 may be adjusted to set a desired height of the lower drum body 16*c* so that it may be positioned relative to a user seated on the seat 14*d*. The lower drum body 16*c* has a pivot shaft 18*d* about which the hydraulic resistance vane drum of the lower drum body 16*c* pivots.

A body height adjustment assembly 18 is coupled to the frame 12*a*. The body height adjustment assembly 18 permits adjustment of the upper drum body 12*c* relative to the occupant seated on the seat 14*d*. The body height adjustment assembly 18 includes an outer cylinder arm 18*a* that is adjustably carried by the inner cylinder arm 18*b*. A body height adjustment pin 18*c* is received through the outer cylinder arm 18*a* and inner cylinder arm 18*b*. The upper drum body 16*c* has a pivot arm 18*d* about which the hydraulic resistance vane drum of the lower drum body 16*c*.

A backrest adjustment assembly 20 is coupled to the frame 12*a* at an aft end of the hydraulic resistance exercise apparatus 10 via an upper frame connector 20*e*. The backrest adjustment assembly 20 adjustably carries a backrest 20*a* within the frame 12*a*. The back rest 20*a* is carried on a backrest rod 20*b* that is adjustable relative to a backrest tube 20*c*. A backrest adjustment pin 20*d* retains the backrest rod 20*b* and the backrest tube 20*c* at a selected position to set the backrest 20*a* at a desired lateral displacement relative to the frame 12*a* and the seat 14*d*.

A proximal end of an arm bar 22 is coupled to the pivot shaft 18*e* of the upper drum body 12*c*. A hand grip 24 is disposed at a distal end of the arm bar 22. The arm bar is operable in a back and forth motion to enable the user to exercise their upper body and arms.

A proximal end of a leg bar 26 is coupled to the pivot arm 18*d* of the lower drum body 16*c*. A footrest 28 is adjustably attached to a distal end of the leg bar 26 via a slidable footrest adjustment 28*a*. Toe loops 30 extend above an upper surface of the footrest 28 to secure the wearer's toes while exercising their lower legs. The footrest 28 and leg bar 26 are operable in a back and forth motion to enable the user to exercise their legs.

A gear assembly 32 may be operatively coupled to each of the upper drum body 12*c* and the lower drum body 16*c*. The gear assembly 32 is configurable to adjust a resistance of the hydraulic resistance exercise apparatus 10. Each of a plurality of in-line hydraulic vane cylinders 50 are selectively engageable to adjust the resistance of the hydraulic resistance exercise apparatus. The gear assembly 32 may include a plurality of planetary gear sets 34, 36 comprised of a sun gear 34*a* and one or more planetary gears 34*b*, 36*b*. A driven variable gear cluster 36*c* may also be provided. A clutch 36*a*, such as a dog clutch, may be provided to allow the user to shift to select a planetary gear 36*b* from among one of the plurality of planetary gear sets 34, 36 to select a desired resistance while exercising.

Figure 5A:
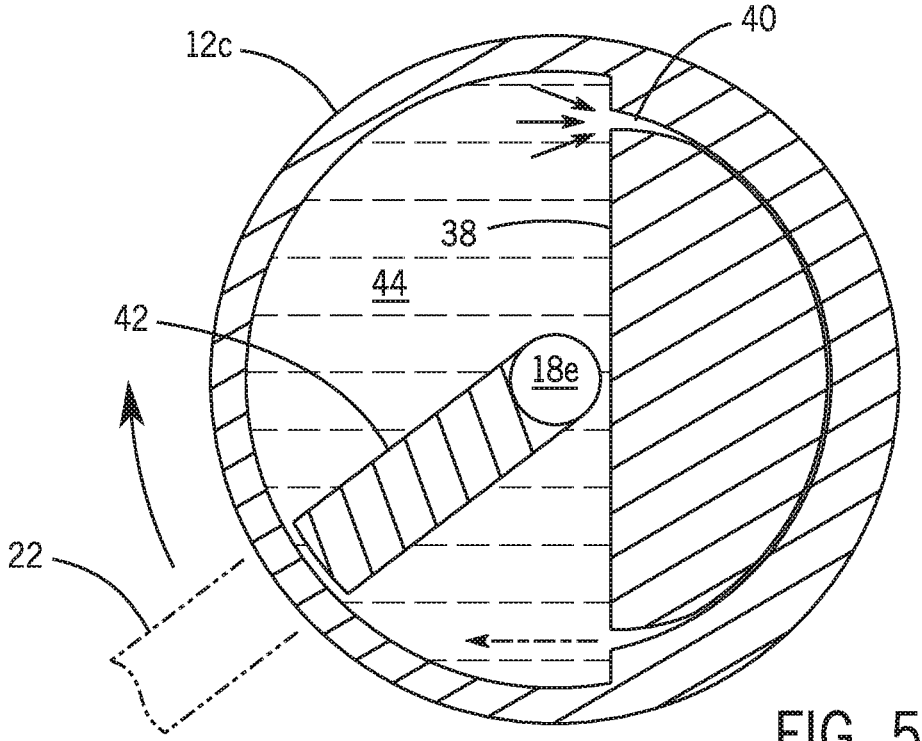
FIG. 5A is a cross-sectional view of the hydraulic exercise apparatus in a first orientation of taken on line 5A-5A of FIG. 4.
Figure 5B:
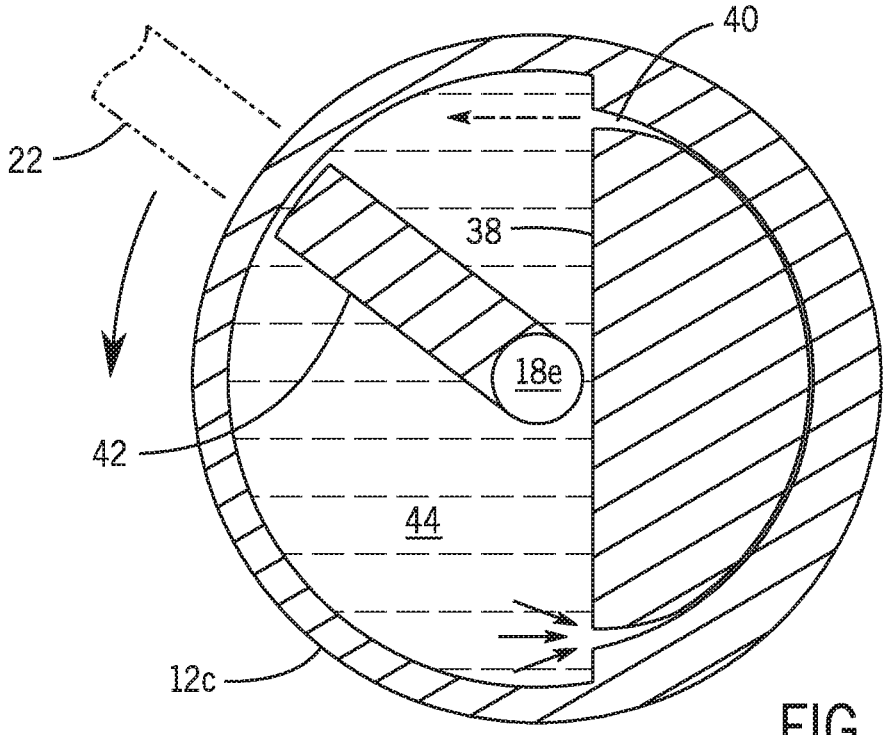
FIG. 5B is a cross-sectional view, similar to FIG. 5A, in a second orientation of the hydraulic exercise apparatus.
Figure 6A:
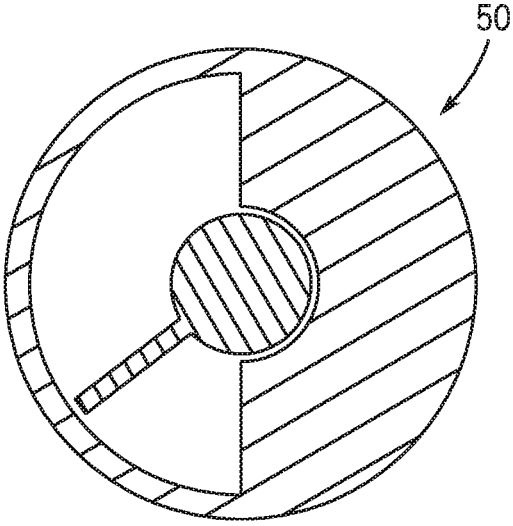
FIGS. 6A-6E: are alternate cross-sectional views of the hydraulic exercise apparatus, similar to FIGS. 5A & 5B.
Figure 6B:
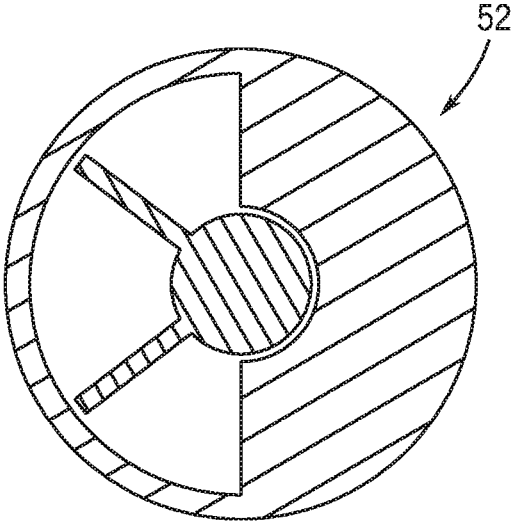
Figure 6C:
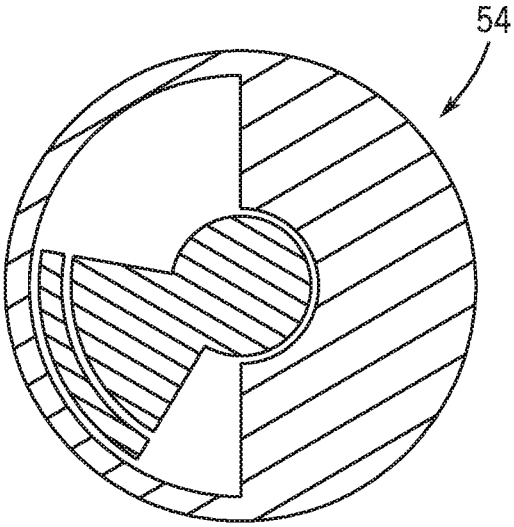
Figure 6D:
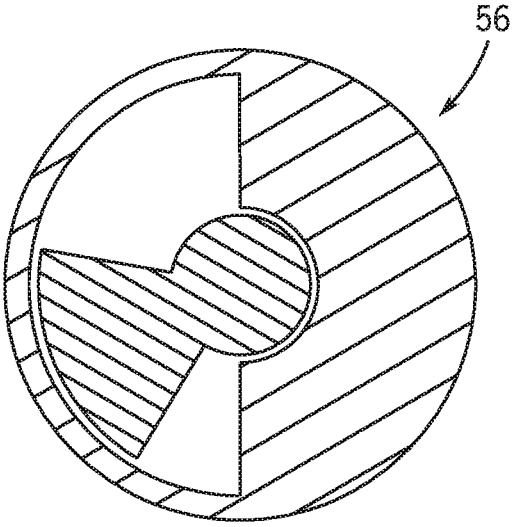
Figure 6E:
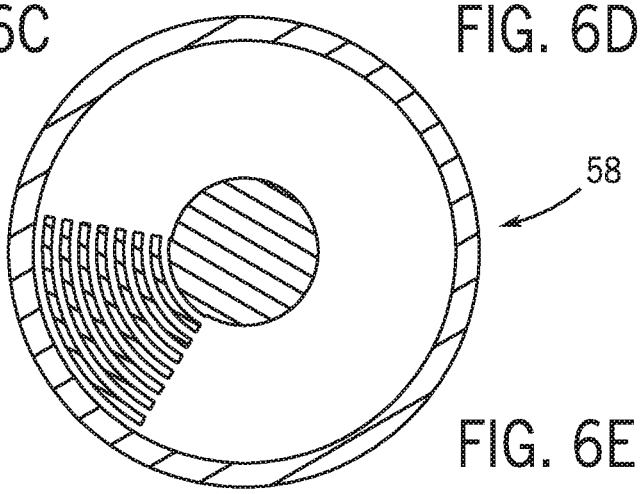

As seen in reference to FIGS. 5A and 5B, each of the upper drum body 12*c* and the lower drum body 16*c* have a hydraulic vane cylinder having an internal hydraulic block 38. One or more hydraulic channels 40 are defined within the internal hydraulic block 38. A vane 42 is carried by the pivot arms 18*d* and pivot shaft 18*e*. A hydraulic fluid 44 is contained within the hydraulic vane cylinder. Operation of the arm bar 22 and the leg bar 26 encounter resistance by the vane 42 to urge the hydraulic fluid 44 against the internal hydraulic block 38 and the hydraulic fluid 44 is urged through the one or more hydraulic channels 40.

Various non-limiting embodiments of the hydraulic vane cylinders are shown in reference to FIGS. 6A through 6E. The various embodiments may include one or more vanes 42. Alternative embodiments include one or more hydraulic channels defined through the vanes 42. A plurality of hydraulic vane cylinders could be arranged in-line. The resistance may be varied by selective engagement of the one or more of the plurality of hydraulic vane cylinders engaged.

As will be appreciated, differing frame 12*a* configurations and dispositions of the upper drum body 12*c* and the lower drum body 16*c* to target differing muscle groups and exercises. In the embodiment shown, the user can adjust one or more of the seat 14*d*, the back rest 20*a*, footrest 28, or the upper drum body 12*c* and lower drum body 16*c* to adjustably configure the hydraulic resistance exercise apparatus to the anthropomorphic measurements of the user and a desired exercise regimen.

Once adjusted the user can manipulate one or more of the arm bar 22 and the leg bar 26 to perform an exercise regimen. As indicated previously, operation of the arm bar 22 and the leg bar 26 against the resistance of the hydraulic fluid 44 contained within the hydraulic vane cylinders provides a convenient, contained workout system.

It should be understood, of course, that the foregoing relates to exemplary embodiments of the invention and that modifications may be made without departing from the spirit and scope of the invention as set forth in the following claims.

What is claimed is:

1. A hydraulic resistance exercise apparatus, comprising:

a frame adjustably supporting an upper drum body and a lower drum body;

an arm bar pivotally attached to the upper drum body;

a leg bar pivotally attached to the lower drum body;

a seat adjustably attached to the frame;

a hydraulic vane cylinder in each of the upper drum body and the lower drum body, each hydraulic vane cylinder having at least one vane rotationally coupled with one of the arm bar and the leg bar, each hydraulic vane cylinder having one or more hydraulic channels, such that operation of one of the arm bar and the leg bar rotationally urges the at least one vane against a hydraulic fluid contained within the respective hydraulic vane cylinder under a resistance by passage of the hydraulic fluid through the one or more hydraulic channels; and a gearbox assembly coupled to each of the upper drum body and the lower drum body, the gearbox assembly configured to provide a user selectable resistance to movement of one or more of one or both of the arm bar and the leg bar.

2. The hydraulic resistance exercise apparatus of claim 1, wherein the gearbox assembly further comprises:

one or more planetary gear assemblies having a plurality of planetary gears and a sun gear.

3. The hydraulic resistance exercise apparatus of claim 2, wherein the gearbox assembly further comprises:

a clutch to selectively engage the one or more planetary gear assemblies.

4. A hydraulic resistance exercise apparatus, comprising:

a frame adjustably supporting at least one drum body;

one of an arm bar and a leg bar pivotally attached to the at least one drum body;

a hydraulic vane cylinder in each of the at least one drum body, the hydraulic vane cylinder having one or more hydraulic channels and at least one vane rotationally coupled to one of the arm bar and the leg bar, such that operation of one of the arm bar and the leg bar rotationally displaces the at least one vane and urges a hydraulic fluid contained within the hydraulic vane cylinder under a resistance by passage of the hydraulic fluid through the one or more hydraulic channels;

a seat adjustably attached to the frame; and a gearbox assembly coupled to the at least one drum body, the gearbox assembly configured to provide a user selectable resistance to movement of one or both of the arm bar and the leg bar.

5. The hydraulic resistance exercise apparatus of claim 4, wherein the gearbox assembly further comprises:

one or more planetary gear assemblies having a plurality of planetary gears and a sun gear.

6. The hydraulic resistance exercise apparatus of claim 5, wherein the gearbox assembly further comprises:

a clutch to selectively engage the one or more planetary gear assemblies.

* * * * *